United States Patent [19]

Henderson

[11] 4,037,457

[45] July 26, 1977

[54] SUPPORT TABLE FOR PIPE BENDER

[76] Inventor: John E. Henderson, 8404 Locust Drive, Kirtland, Ohio 44094

[21] Appl. No.: 614,324

[22] Filed: Sept. 17, 1975

[51] Int. Cl.[2] ..... B21D 7/04

[52] U.S. Cl. ..... 72/389

[58] Field of Search ..... 72/298, 307, 389, 250, 72/420, 34

[56] References Cited

U.S. PATENT DOCUMENTS

| | | | |
|---|---|---|---|
| 3,075,568 | 1/1963 | Bright | 72/34 X |
| 3,181,323 | 5/1965 | Bos | 72/307 X |
| 3,396,565 | 8/1968 | Miller | 72/389 X |
| 3,581,537 | 1/1971 | Lance | 72/389 X |
| 3,760,626 | 9/1973 | Schros | 72/389 |

*Primary Examiner*—Leon Gilden

*Attorney, Agent, or Firm*—William N. Hogg

[57] ABSTRACT

A support table for a pipe bender is disclosed. The table includes a pair of upright supports, each having apertures to pivotally mount one end of a pipe bender. The table includes a pair of rails having a member for supporting a pipe slidably mounted thereon. The side rails are mounted for vertical and level adjustment so that a pipe can be leveled on the table for positioning during bending.

8 Claims, 7 Drawing Figures

SUPPORT TABLE FOR PIPE BENDER

BACKGROUND OF THE INVENTION

One of the conventional techniques for bending pipe is by utilizing a power driven pipe bender, which pipe bender employs a pair of adjustable shoes and a power driven arcuate bending mandrill. Different size shoes and mandrills are utilized for bending various size pipes. Conventionally these power driven units have been utilized lying flat on the floor to bend the pipe with the amount of bend being mesured by a protractor. This technique for bending provides certain difficulties, particularly that of accurately bending the pipe quickly to the exact desired angle, and also in making compound bends; i.e. more than a single bend in a pipe.

There have been prior art proposals for mounting the benders on stands, but these stands have proven ineffective and inefficient in that they did not adequately allow for mounting of the bender for various size pipes thereon. Also, they did not provide for accurately aligning and postioning pipe of various sizes for various size bends by the unit.

SUMMARY OF THE INVENTION

Accordng to the present invention a support table for a pipe bender is provided which includes a pair of spaced upright supports, each of the supports including means to pivotally mount a pipe bender therebetween. The support table includes pipe support means and means to adjust the pipe support means to a plurality of vertical level positions whereby the relationship of the pipe to the bending device can be maintained in a level horizontal configuration at the various positions of support for the pipe bender.

DESCRIPTION OF THE PREFERRED EMBODIMENT

Figure 1:
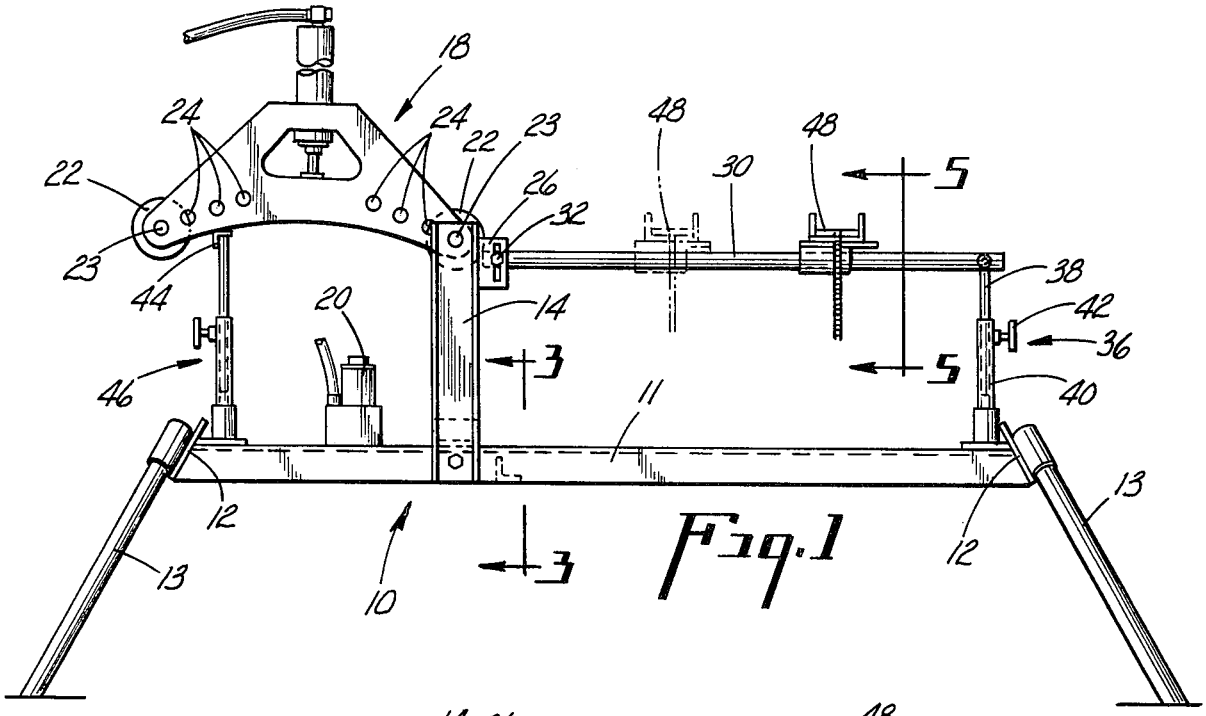
FIG. 1 is a side elevational view of a support table for a pipe bender showing a pipe bender mounted thereon.
Figure 2:
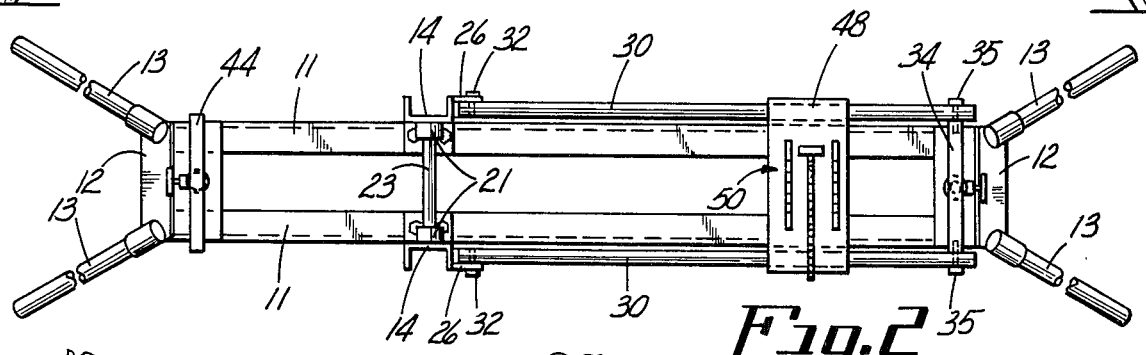
FIG. 2 is a plan view of the device of FIG. 1 with the pipe bender and power unit removed.
Figure 3:
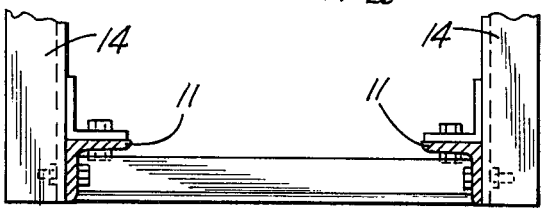
FIG. 3 is a sectional view taken substatially along the plane designated by the line 3—3 of FIG. 1.
Figure 4:
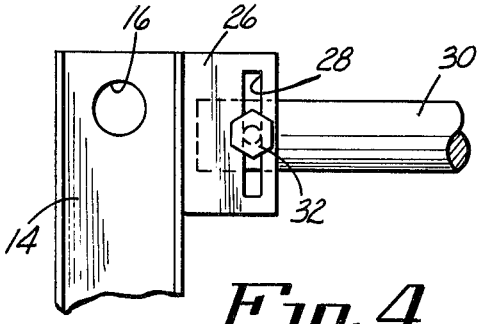
FIG. 4 is a detailed view of the mounting of one of the support rails to one of the upright members for vertical adjustment.
Figure 5:
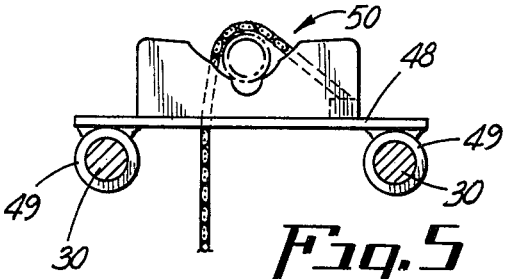
FIG. 5 is a sectional view taken substantially along the plane designated by the line 5—5 of FIG. 1.
Figure 6:
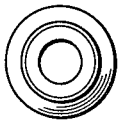
FIG. 6 is an end elevational view of an adaptor bushing for the table.
Figure 7:
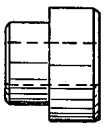
FIG. 7 is a side elevational view of the bushing of FIG. 6.

Referring now to the drawing, one embodiment of a support table for a pipe bender according to the present invention is shown. The support table includes a bed 10 formed of a pair of channel members 11 interconnected at opposite ends by cross pieces 12. The bed is supported by a plurality of legs 13 depending from sockets (unnumbered) welded thereto. The legs depend at an angle for greater stability of support. Bolted to the bed 10 are a pair of upright support members 14, each of which extends generally verticaly upwardly from the bed 10. The upright support members 14 each have an opening 16 near the top thereof, which opening 16 is adapted to support one end of a conventional pipe bending device designated generally as 18. (The particular type bender depicted is the Greenlee Bender manufactured by the Greenlee Tool Company, Rockford, Ill. However, other benders of this type can be accommodated by the present invention.) The pipe bending device, which is shown in FIG. 1, includes a power unit 20 which is adapted to be mounted therebelow on the support bed 10. The pipe bending device 18 also includes bending shoes 22 at opposite ends thereof, which bending shoes are each mounted on a shaft 23. The shaft 23 can be positioned in any one of a plurality of apertures 24 and the bending shoes 22 adjusted to accommodate various sizes of pipe, all of which is conventional with power benders and does not per se form a part of this invention. Preferably annular spacers 21 are provided around the apertures 24 to properly align a bender between the upright members 14. The openings 16 in the upright support members 14 are adapted to receive the opposite ends of the shaft 23 and pivotally mount the shaft of one of the shoes 22 therein for pivotal movement therein. The opposite end of the bender is free and unsupported. Also, preferably bushings or collars, one of which is shown in FIGS. 6 and 7, can be provided to be inserted into the openings 16 to change the size thereof to adapt it for use of various size shafts of different benders.

Each of the upright support members 14 is provided with a bracket 26 near the top thereof, each of the brackets 26 being provided with a vertically extending slot 28. A pair of support rails 30 are provided, one end of each of which is mounted to one of the brackets 26 by means of a bolt 32 threadably engaged into the support rail 30 extending through the slot 28 to thereby provide for adjustment of the vertical position of the end of the rail 30 with respect to the upright support member 14.

The opposite ends of the support rails 30 are interconnected by a crosstie 34 mounted to each of the side rails by means of pins 35 extending therebetween. The crosstie 34 is secured to an adjustable member 36 which includes a support post 38 slidably mounted in a sleeve 40 through which extends a thumb screw 42 for loosening and tightening. By loosening the thumb screw 42 the support post 38 can be raised and lowered to thus raise and lower the rearward ends of the support rails 30.

A forward support piece 44 is also provided which is connected to a second adjustable member 46 which is of the same construction as the adjustable member 36.

A slide member 48 is provided which is slidably mounted by means of annular shoes 49 slidably engaging the support rails 30. A chain clamp of conventional design 50 is mounted on the slide member 48 and adapted to secure a pipe thereto.

As was explained above, the pipe bender 18 can be utilized with the bending shoe 22 and the shaft 23 thereof in various positions, the shaft being selectively positionable in any one of the apertures 24 and the proper bending shoe selected for the size pipe being bent. Because of this the position of the bending shoe with respect to the upright members 14 will change somewhat, depending upon the selected size of the shoe and the position of the shoe in the bender. The construction and adjustable mounting of the support rails 30 in the brackets 26 and on the adjustable member 36 allow these rails to be raised, lowered and leveled so that pipe scured on the slide member 48 by the clamp 50 can be maintained in an exact horizontal level relationship with respect to the bender with the other end of the pipe also maintained level by means of the adjustable member 46 so that whenthe pipe bending device 18 is operated to bend the pipe the start of the bend will be with the pipe in an absolutely level horizontal position. Hence the bend can be accurately and quickly measured by means of a simple protractor which will directly read the bend angle. It will be readily apparent that by securing the pipe in the slide member 48 and with the adjustment of the support rails 30 to properly position the selected size pipe in the proper bending shoes repeated bends can also be made with this single setting when the same size and grade of pipe is used, since the adjustment of the table remains constant and each time the pipe is secured thereto its relationship to the bender and the table is exactly the same as the pipe in the preselected setup.

Also, it is to be understood that during the bending operation the pipe bender 18 will pivot in a clockwise direction about the shaft 23. Thus by having the support post 14 spaced apart and with a space therebetween, when the shaft 23 is positioned in the inside most apertures 24 there will be room for the pipe bender during this pivoting operation to swing between the supports 14 without obstruction. However, if for any reason there is not sufficient clearance because of the location of the power unit 20, a separate side table can be constructed and secured to the bed 10 on the side thereof to allow any additional room.

It will also be noted that the slide member 48 is adjustable longitudinally along the support rails 30 so that if desired the adjustment can be made with the pipe clamped in one position, and the bend made at another with the pipe clamped at another position to provide greater accuracy of measurement and also to provide stability of securing during bending. For example, it may be desired to move the slide member 48 to the remote end of the support rails 30 when setting the device up for the bends to accurately measure the position of the pipe and then slide the device to the close end for bending in order to better secure the pipe and hold it from raising. In any event, the slidability of the slide member 48 provides for flexibility of measurement and allows for optimum clamping of various lengths of pipe which may be encountered and require bending.

I claim:

1. A support table for a pipe bender comprising, a pair of upright support members, said upright support members including means to pivotally mount one end of a pipe bender therebetween, first and second support means on opposite sides of said pivotal mounting means, and means to vertically adjust both said first and second pipe support means to a plurality of horizontal positions; whereby various size pipes can be supported within the bender in a level configuration irrespective of the shoe size and position of the bender.

2. The invention as defined in claim 1 wherein one of said pipe support means includes an elongated support device and the adjusting means therefor includes means adjustable at opposite ends thereof whereby the device may be adjusted for height and level.

3. The invention as defined in claim 2 wherein one end of said elongated device is secured to said upright members and movable to a plurality of vertical positions thereon.

4. The invention as defined in claim 3 wherein said pipe support means includes a pair of elongated pipe support means includes a pair of elongated pipe support rails.

5. The invention as defined in claim 4 wherein each of the support rails is independently secured for vertical adjustment to one of said upright support members.

6. The invention as defined in claim 2 further characterized by said pipe support means including a selectively positionable slide member having pipe engaging means carried thereby.

7. The invention as defined in claim 1 further characterized by said support table including means to support a power unit for the pipe bender.

8. The invention as defined in claim 1 wherein said mounting means includes bushing means selectively mountable on said upright support means whereby to center a bender pivotally mounted thereon.

* * * * *